US005362364A

United States Patent [19]

Katsura et al.

[11] Patent Number: 5,362,364

[45] Date of Patent: Nov. 8, 1994

[54] PROCESS FOR PRODUCING ALKALINE PAPER

[75] Inventors: Toru Katsura; Hideaki Senoh, both of Tokyo, Japan

[73] Assignee: Mitsubishi Paper Mills Limited, Tokyo, Japan

[21] Appl. No.: 120,224

[22] Filed: Sep. 14, 1993

Related U.S. Application Data

[63] Continuation of Ser. No. 782,487, Oct. 25, 1991, abandoned.

[30] Foreign Application Priority Data

Oct. 26, 1990 [JP] Japan ..... 2-290331
Mar. 12, 1991 [JP] Japan ..... 3-073956

[51] Int. Cl.[5] ..... D21H 21/04
[52] U.S. Cl. ..... 162/158; 162/161; 162/175; 162/179; 162/183

[58] Field of Search ..... 162/158, 179, 175, 161, 162/199, 183; 106/213, 243

[56] References Cited

U.S. PATENT DOCUMENTS 3,130,118 4/1964 Chapman ..... 106/213
4,861,376 8/1989 Edwards et al. ..... 162/179
5,045,104 9/1991 McCoy ..... 162/161

*Primary Examiner*—Peter Chin
*Attorney, Agent, or Firm*—Finnegan, Henderson, Farabow, Garrett & Dunner

[57] ABSTRACT

An alkaline paper is produced by adding a cationic starch containing an alkyltetrahydro-1,3,5-2H-thiadiazine-2-thione or a bromonitroalcohol, and an alkylketene dimer to a paper stock. Formation of slime in the paper stock system is substantially inhibited and an alkaline paper excellent in sizing characteristics and safety to man is obtained.

8 Claims, No Drawings

PROCESS FOR PRODUCING ALKALINE PAPER

This application is a continuation of application Ser. No. 07/782,487 filed Oct. 25, 1991, now abandoned.

BACKGROUND OF THE INVENTION

1. Field of the Invention

The present invention relates to a process for producing an alkaline paper, and in particular, to a process for producing alkaline-sized papers exhibiting an excellent sizing property and entailing no hazard to human health, in which formation of slime is substantially inhibited.

2. Description of the Related Art

Slime is viscous and heterogeneous material formed by microbiological growth at various points within a paper stock preparation system, particularly, at points such as inside wall of pipelines, chests and the like where flow rate of the paper stock is slow. Slime becomes foreign matter to paper, and forms spots on paper. These adversely affect the appearance of paper. In addition, slime causes paper breaks and soiling of press fabrics. These disturb the operation of papermaking. Therefore, various methods have been contemplated to control slime.

Among the methods, one which is thought to be the most effective is suppressing microbiological growth or sterilizing microorganisms by adding slimecides to a paper stock.

However, it is difficult nowadays to find an effective slimecide and to determine a spot of addition in paper making systems where increased recycling of white water and a shift from an acid system to an alkaline system are required.

Moreover, most slimecides are toxic and affecting harmfully a living thing, so that safety of the papers which might be contaminated by use of such chemicals must be proved.

As slimecides, organic nitrogen and sulfur containing compounds such as 5-chloro-2-methyl-4-isothiazoline-3-thione and the like, organic bromine compounds such as 2,2-dibromopropionamide and the like, and organic nitrogen compounds such as dichloroisocyanate and the like have heretofore been known. These chemicals are added to a paper stock continuously or shockwise (or in a "slug" method—where the toxicants are added fairly rapidly over a relatively short period of time in order to maintain a high concentration for a short time).

It happens often that a sufficient slime controlling effect can not be obtained in a paper making system which has shifted to alkaline and in which slimecides are added to a paper stock according to the conventional methods. In an alkaline paper making system, a considerable amount of a cationic starch which is a nutrient source for microorganisms is used and pH of the stock system is maintained within a range, 7.0–8.5, favoring microbiological growth.

A slimecide, if there any, having sufficient slime controlling effect though under that environment, may interfere with sizing performance of alkylketene dimers used in an alkaline paper making system as sizing agents, or may be one too toxic and safety of it is hardly proved.

Therefore, it has been very difficult to find appropriate slimecides and slime controlling methods.

In order to solve the aforementioned problems, the present inventors have carried out researches on slime controlling effects of a variety of slimecides to be added to an alkaline paper stock system containing a cationic starch and an alkylketene dimer, safety to man in use of the toxicants and their influence on sizing characteristics of papers made of the stock.

As a result, it has been found that specific slimecides are favorable. The researches on their use has brought to light a specific manner of addition of them which further stimulates their slime controlling effects.

SUMMARY OF THE INVENTION

An object of the present invention is to provide a process for producing an alkaline paper where little slime is formed.

Another object of the present invention is to provide a process for producing an alkaline paper exhibiting excellent sizing characteristics.

A further object of the present invention is to provide a process for producing an alkaline paper which is not harmful to man.

According to the present invention, there is provided a process for producing an alkaline paper which comprises adding a cationic starch containing a slimecide selected from the group consisting of an alkyltetrahydro-1,3,5-2H-thiadiazine-2-thione and a bromonitroalcohol of the formula (1),

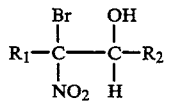

(1)

where $R_1$ and $R_2$ are independently selected from the group consisting of hydrogen, methyl and ethyl.

DESCRIPTION OF THE PREFERRED EMBODIMENTS

According to the present invention, the above-mentioned slimecides are effective.

Regarding the manner of addition of the slimecide, it is more preferable, in order to obtain maximized slime controlling effect of it, to add it firstly to a cationic starch solution which is a major nutrient source to simulate microbiological growth and then to add the resulting slimecide containing cationic starch solution to a paper stock, rather than to add it directly to the paper stock according to a conventional manner.

Examples of the cationic starch used in an alkaline paper stock according to the present invention include tertiary amine derivatives or quaternary ammonium salts of starches derived from potato, tapioca, wheat and the like.

Furthermore, amphoteric starches containing anionic groups less than cationic groups may be used.

The amount of the cationic starch to be added is preferably 0.1–3.0% by weight based on the paper stock solid matter.

As alkylketene dimers in the present invention, there may be used alkylketene dimers, for example, as described in U.S. Pat. Nos. 2,785,067 and 2,865,743, and Japanese Patent Application Laid-open Nos. 40605/1977, 98997/1980, 116898/1980, 132799/1980, and 101998/1981.

The amount of the alkylketene dimer to be added is usually 0.05–0.5% by weight based on the paper stock solid matter.

The alkyltetrahydro-1,3,5-2H-thiadiazine-2-thione used in the present invention includes, for example, 3,5-dimethyltetrahydro-1,3,5-2H-thiadiazine-2-thione (abbreviated to "DMTT") and the like slime controlling agents.

The amount of this slime controlling agent to be added differs depending on the kind of pulp furnish, degree of beating, amount of chemicals added and the like, but it is preferably 100–3000 ppm based on the cationic starch solid matter.

The manner of adding the slime controlling agent to the paper stock is preferably such that the alkyltetrahydro-1,3,5-2H-thiadiazine-2-thione is firstly added to a cationic starch glue having a solid matter concentration of 5% or less and then the resulting glue is added to the paper stock.

Further, it is also possible to add the slimecide to the cationic starch glue upon emulsifying and dispersing an alkylketene dimer in it.

Examples of the bromonitroalcohol compound of the formula (1) of the present invention are 2-bromo-2-nitropropane-1,3-diol and the like slime controlling agents.

The amount of this slime controlling agent to be added differs depending on the kind of pulp furnish, degree of beating, an amount of chemicals added and the like, but it is preferably 5–500 ppm based on the cationic starch solid matter.

The manner of adding the slimecide to the paper stock is preferably such that the bromonitroalcohol compound is firstly added to a cationic starch glue having a solid matter concentration of 5% or less and then the resulting glue is added to the paper stock.

Further, it is also possible to add the slimecide to the cationic starch glue upon emulsifying and dispersing an alkylketene dimer in it.

The alkaline paper produced according to the present invention means a paper formed under an alkaline region pH ranging from 7.0 to 8.5 of a paper stock, to which dyes, fillers, strengthening agents, retension aids, and the like usually employed in paper making may be added, if desired.

The alkaline paper produced according to the present invention may be applied for a variety of fields of use, for example, non-coated printing and writing papers, continuous form papers, electrophotographic image receiving papers, and the like; base stock for coated papers, thermal papers, carbonless copy papers, ink jet papers, and the like. It is applied also for such field of use like food packaging papers where safety to man as well as sizing characteristics is critical.

According to the present invention, i.e. by use of an alkyltetrahydro-1,3,5-2H-thiadiazine-2-thione or a bromonitroalcohol of formula [I], as a slimecide, and by employing said manner of adding the slimecide, wherein the slimecide is firstly added to a cationic starch glue, which in turn is added to an alkaline paper stock together with an alkylketene dimer, formation of slime in the paper stock system is substantially inhibited, and an alkaline paper excellent in sizing characteristics and in safety to man is obtained.

The present invention will be explained further in detail referring to the following illustrative but non-limiting examples. Parts and percents are by weight unless otherwise specified.

EXAMPLE 1

An LBKP beaten up to Canadian Standard Freeness (CSF) of 350 ml and an NBKP beaten up to freeness of 450 ml (weight ratio of 7 to 3) were mixed to prepare a beaten pulp.

To 100 parts of the resulting beaten pulp were added 10 parts of precipitated calcium carbonate (TP 121, trade name, manufactured by Okutama Kogyo K. K.), 1.0 part of a cationic starch (Cato F, trade name, manufactured by Ohji National K. K.) to which 3,5-dimethyltetrahydro1,3,5-2H-thiadiazine-2-thione (DMTT; Sansalent 330, trade name, Sanshin Kagaku K. K.) had been added in advance in an amount of 600 ppm based on the starch glue solid matter, and 0.1 parts of an alkylketene dimer sizing agent (SPK 903, trade name, Arakawa Kagaku K. K.). To the resulting mixture was finally added mill water to prepare a paper stock consistency of which was 2.5% solid.

The paper stock immediately after prepared was used to prepare a hand sheet having a basis weight of 60 g/m$^2$. The resulting sheet was dried at 80° C. for 5 min. in a hot air drier. The sheet thus prepared was called "Sample 1-1".

A part of the paper stock as obtained above was stored at 32° C. for 7 days and then, filtered by means of a wire screen. The filtrate was subjected to ninhydrin reaction and the effectiveness of the slimecide controlling agent was evaluated based on the result of the ninhydrin reaction. The filtrate was called "Sample 1-2".

Comparative Example 1

The procedure of Example 1 was repeated except that 1.0 parts of the cationic starch (Cato F) alone (not containing DMTT) and 30 ppm of DMTT based on the paper stock solid matter (corresponding to 3330 ppm based on the cationic starch glue solid matter) were added to the paper stock, and a hand sheet and a filtrate were obtained. These were called "Sample 2-1" and "Sample 2-2", respectively.

COMPARATIVE EXAMPLE 2

The procedure of Comparative Example 1 was repeated except that 30 ppm of 5-chloro-2-methyl-4-isothiazoline-3-thione was added in place of DMTT, and a hand sheet and a filtrate were obtained, which were called "Sample 3-1" and "Sample 3-2", respectively.

COMPARATIVE EXAMPLE 3

The procedure of Comparative Example 1 was repeated except that 30 ppm of 2,2-dibromopropionamide was added in place of DMTT, and a hand sheet and a filtrate were obtained, which were called "Sample 4-1" and "Sample 4-2", respectively.

Test results of the evaluations on the above-mentioned hand sheets and filtrates are summarized in Table 1 and Table 2.

TABLE 1

| Sample No. | Sizing degree (sec.) | Mutagenicity test |
|---|---|---|
| 1-1 | 22 | Negative |
| 2-1 | 23 | Negative |
| 3-1 | 23 | Positive |
| 4-1 | 15 | Negative |

TABLE 2

| Sample No. | Ninhydrin reaction |
|---|---|
| 1-2 | – |
| 2-2 | + |
| 3-2 | – |
| 4-2 | – |

In the above, the sizing degree was measured by Testing method for Stöckigt sizing degree of paper according to JIS P 8122.

The 0.1% addition of the alkylketene dimer should develop the sizing degree of 20–25 sec. unless other chemicals used together interfere with it.

The mutagenicity test was carried out according to Ministry of Labor, Labor Standards Office, Order No. 261 (May 18, 1985). That is, each hand sheet was subjected to extraction using a mixture of benzene/ethanol (9/1, by volume) at 80° C. for three hours, and the resulting extractant was subjected to a reverse mutation test using *Salmonella typyhimurium* TA 100 without following a metabolism activating method.

When the number of reverse mutation colony increased to twice or more that in the case of dimethyl sulfoxide used as a control solvent, it was determined "positive". A sample determined "positive" is likely to have mutagenicity, so that its "safety-to-man" criteria fails to be proved.

Ninhydrin reaction was effected by adding 0.5 ml of a 1% aqueous solution of nonhydrin to 10 ml of the filtrate, and the result was evaluated depending on the degree of color change of the resulting solution to reddish purple. When the color of the solution changed to reddish purple, the result was shown with a sign "+", indicating that slime was formed. Comparing Sample 1-2 with Sample 2-2, it is clear that the addition of a cationic starch containing DMTT to a paper stock results in an excellent slime inhibiting effect though the amount of said slimecide added based on the paper stock solid matter is as small as only about 1/5 times the amount of said slimecide added in a conventional manner.

Comparing Sample 1- 1with Sample 3-1 and Sample 4-1, it is evident that a compound such as DMTT is a slimecide which is very safe for man and has a minimal adverse effect on sizing.

EXAMPLE 2

An LBKP beaten up to CSF of 350 ml and an NBKP beaten up to freeness of 450 ml (weight ratio of 7 to 3) were mixed to prepare a beaten pulp.

To 100 parts of the resulting beaten pulp were added 10 parts of precipitated calcium carbonate (TP 121, trade name, manufactured by Okutama Kogyo K. K.), 1.0 part of a cationic starch (Cato F, trade name, manufactured by Ohji National K. K.) to which 2-bromo-2-nitropropane-1,3-diol (Permachem SL-700, trade name, manufactured by Permachem Asia Co.) had been added as a slimecide in advance in an amount of 300 ppm based on the starch glue solid matter, and 0.01 parts of an alkylketene dimer sizing agent (SPK 903, trade name, Arakawa Kagaku K. K.). To the resulting mixture was finally added mill water to prepare a paper stock consistency of which was 2.5% solid.

The paper stock immediately after prepared was used to prepare a handmade sheet having a basis weight of 60 g/m$^2$. The resulting sheet was dried at 80° C. for 5 min. in a hot air drier. The sheet thus prepared was called "Sample 5-1".

A part of the paper stock as obtained above was stored at 32° C. for 7 days and then, filtered by means of a wire net. The filtrate was subjected to ninhydrin reaction and the effectiveness of the slime controlling agent was evaluated based on the result of the ninhydrin reaction. The filtrate was called "Sample 5-2".

Comparative Example 4

The procedure of Example 2 was repeated except that 1.0 parts of cationic starch (Cato F) alone (not containing a slimecide-i.e. 2-bromo-2-nitropropane-1,3-diol) and 30 ppm of the slimecide based on the solid matter of the paper stock were used, and a hand sheet and a filtrate were prepared, which were called "Sample 6-1" and "Sample 6-2", respectively.

Comparative Example 5

The procedure of Comparative Example 4 was repeated except that 30 ppm of 5-chloro-2-methyl-4-isothiazoline-3-thione was added in place of 2-bromo-2-nitropropane-1,3-diol, and a hand sheet and a filtrate were obtained, which were called "Sample 7-1" and "Sample 7-2", respectively.

Comparative Example 6

The procedure of Comparative Example 4 were repeated except that 30 ppm of 2,2-dibromopropionamide was added in place of 2-bromo-2-nitropropane-1,3-diol, and a manmade sheet and a filtrate were obtained, which were called "Sample 8-1" and "Sample 8-2", respectively.

Characteristics of the above-mentioned hand sheets and filtrates are shown in Table 3 and Table 4.

TABLE 3

| Sample No. | Sizing degree (sec.) | Mutagenicity test |
|---|---|---|
| 5-1 | 24 | Negative |
| 6-1 | 23 | Negative |
| 7-1 | 23 | Positive |
| 8-1 | 15 | Negative |

TABLE 4

| Sample No. | Ninhydrin reaction |
|---|---|
| 5-2 | – |
| 6-2 | + |
| 7-2 | – |
| 8-2 | – |

Measurement of the sizing degree, evaluation of the mutagenicity, and ninhydrin reaction in Table 3 and Table 4 were conducted in the same manner as in Table 1 and Table 2.

Comparing Sample 5-2 with Sample 6-2, it is clear that slime formation can be effectively inhibited with a small amount of 2-bromo-2-nitropropane-1,3-diol based on a paper stock solid matter by adding to a paper stock a cationic starch in which said slimecide has been incorporated in advance, as compared with that added in a conventional manner. That is, the amount of said slimecide added in the former manner is only about 1/10 times that added in the latter conventional manner.

Comparing Sample 5-1 with Sample 7-1 and Sample 8-1, a compound such as 2-bromo-2-nitropropane1,3-diol is a slimecide which is neither harmful to man nor adversely affects the sizing property.

Hand sheets obtained according to the present invention were supercalendered to make electrophotographic image receiving sheets and base stock for thermal paper and ink jet paper. To the base stock was applied a thermal coating composition or an ink jet coating composition to make a thermal paper or a ink jet paper, respectively.

The resulting sheets processed into said specific uses were run on a respective image developing unit and evaluated. Functional properties of the sheets, e.g. quality of print developed on the electrophotographic receiving sheet, thermal sensitivity of the thermal paper, and dots spread characteristics of the ink jet paper, were all acceptable.

What is claimed is:

1. A process for producing an alkaline paper which comprises adding a cationic starch solution consisting essentially of a member selected from the group consisting of an alkyltetrahydro-1,3,5-2H-thiadiazine-2-thione present in the cationic starch solution in amounts ranging from 100 to 3000 ppm based on the cationic starch solid matter and a bromonitroalcohol of the formula (1),

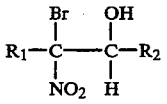

(1)

where $R_1$ and $R_2$ are independently selected from the group consisting of hydrogen, methyl and ethyl, wherein said bromonitroalcohol is present in the cationic starch solution in amounts ranging from 5 to 50 ppm based on the cationic starch solid matter, and an alkylketene dimer to an alkaline paper stock making system.

2. The process according to claim 1 in which the amount of the cationic starch solution added ranges from 0.1 to 3.0% by weight based on the paper stock solid matter.

3. The process according to claim 1 in which the the cationic starch solution has a solid matter concentration of 5% or less.

4. The process according to claim 1 in which the the cationic starch solution has a solid matter concentration of 5% or less.

5. The process according to claim 1 in which the amount of the alkylketene dimer added to the cationic starch solution ranges from 0.05 to 0.5% by weight based on the paper stock solid matter.

6. The process according to claim 1 in which the pH of the paper making stock system is maintained within the range of 7 to 8.5.

7. The process according to claim 1, wherein the member is alkyltetrahydro -1,3,5-2H-thiadiazine-2-thione.

8. The process according to claim 1 wherein the member is a bromonitroalcohol of the formula (1),

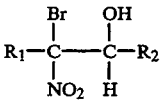

(1)

where $R_1$ and $R_2$ are independently selected from the group consisting of hydrogen, methyl and ethyl.

* * * * *

UNITED STATES PATENT AND TRADEMARK OFFICE

CERTIFICATE OF CORRECTION

PATENT NO. : 5,362,364

DATED : November 8, 1994

INVENTOR(S) : Toru KATSURA et al.

It is certified that error appears in the above-indentified patent and that said Letters Patent is hereby corrected as shown below:

Claim 1, col. 7, line 33, "50" should read --500--.

Signed and Sealed this

Tenth Day of January, 1995

Bruce Lehman

*Attest:*

BRUCE LEHMAN

*Attesting Officer*

*Commissioner of Patents and Trademarks*